United States Patent [19]

Scott et al.

[11] 4,194,681

[45] Mar. 25, 1980

[54] OPENABLE CONTAINER COVER

[75] Inventors: Raymond G. Scott, Oak Brook; Lawrence S. Wysocki, Chicago, both of Ill.

[73] Assignee: Champion International Corporation, Stamford, Conn.

[21] Appl. No.: 972,040

[22] Filed: Dec. 21, 1978

[51] Int. Cl.[2] ..... B65D 5/54; 865D 17/24

[52] U.S. Cl. ..... 229/43; 206/612; 206/628; 206/633

[58] Field of Search ..... 229/43, 3.5 MF; 206/611, 612, 628, 633

[56] References Cited

U.S. PATENT DOCUMENTS

| | | | |
|---|---|---|---|
| 3,054,680 | 9/1962 | Mennen | 229/3.5 MF |
| 3,110,233 | 11/1963 | Mennen | 93/84 |
| 3,144,194 | 8/1964 | Cartwright | 206/628 |
| 3,244,356 | 4/1966 | Wolowicz et al. | 229/43 |
| 3,964,670 | 6/1976 | Amneus | 206/633 |

*Primary Examiner*—Stephen P. Garbe

*Attorney, Agent, or Firm*—Evelyn M. Sommer

[57] ABSTRACT

A paperboard cover adapted for being marginally secured to a container for prepackaged foods comprises circular and arched cut scores defining a pull tongue therebetween. The pull tongue at its free end defines an easy lift tab communicating with a cutout area between the circular and arched cut scores. A protective paperboard tab spans the cutout area and it partially glued to the upper surface of the cover.

4 Claims, 6 Drawing Figures

OPENABLE CONTAINER COVER

BACKGROUND OF THE INVENTION

This invention relates generally to protective covers for prepackaged foods and more particularly it relates to an openable cover adapted to be used in connection with an aluminum pan in which raw corn kernels are popped.

The packaging of foods in metal containers in which they must be heated for serving is a widespread practice. Among the food products packaged in this manner is raw corn kernels for making popped corn. Such packages contain dried corn kernels and cooking oil as well as salt, other flavoring agents and preservatives. The container is covered with an extensible aluminum foil and is provided with a handle. In the heating process, the pan is placed over a source of heat and the corn is popped within the pan causing expansion of the extensible cover.

The aluminum foil used in such a cover is of extremely thin gauge, considerably thinner than the aluminum used for the bottom or sides of the pan. Owing to its thinness, the aluminum foil in the cover is susceptible to damage or perforations. It is therefore necessary to employ an additional cover over the top of the pan when it is offered for sale and the additional cover must be easily openable. Generally a paperboard cover is used and in addition to serving the protective function, it also permits display of advertising matter and identification of the product as well as directions for use. The paperboard cover is anchored in a sealed relation on the container by crimping a margin of the aluminum foil on both of the expansible top and relatively thick container sides.

Prior to heating the popped corn package, a major central part of the paperboard cover must be removed in order to permit the expansible aluminum top to expand through a remaining annular portion of the paperboard cover during the heating. This annular portion of the paperboard cover acts as a gasket for the pan and the thin expandable foil to reduce the loss of steam during popping thus causing the package to function successfully.

To facilitate the removal of the cover, one or more top scores extend on both surfaces of the cover around the peripheral portion thereof. The depth of the top scores is usually less than the depth of the paperboard cover. In order to define a finger tab there has been provided an angular cut or tab terminating in the outer peripheral cut score. When the finger tab is gripped and pulled, the paperboard cover is torn away along the cut score lines thereby exposing the expansible aluminum foil top and leaving, around the rim of the container, a narrow marginal band of paperboard.

A paperboard container cover that is provided with cut scores and an angular cut so as to facilitate easy removal of a major portion thereof, as described hereinabove, is disclosed in U.S. Pat. Nos. 3,054,680 and 3,110,233.

Openable paperboard covers disclosed in the above patents have been used for several years in connection with the popped corn producing containers. The angular cut shape defining a finger tab which acts as a starter for the lid opening and removal of the same has been used because it helps minimize the moisture vapor transmission and helps prevent accidental puncturing of the spun aluminum located underneath. Prior to using the angular cut shape, other die cut shapes were used; however, these proved faulty for one reason or another. Due to the fact that the angular cut or pull tab is normally in the plane of the upper surface of the lid, it has been necessary first to lift the sides of the angular tab. The delicate spun aluminum foil has been frequently punctured by a fingernail or other object when the lid opening process has been started. A small protective circular tab has been placed underneath the area of the angular cut but despite this precaution the above-mentioned probelm has still taken place.

It is therefore a primary object of this invention to provide a paperboard cover for prepackaged foods container which at the start of opening operation substantially reduces the danger of puncturing the underlying aluminum foil of the container.

Another object of this invention is to make the lid opening and removal easier.

SUMMARY OF THE INVENTION

In keeping with this and other objects which will become apparent hereinafter, one feature of this invention resides in replacing the existing angular cut with a cutout area communicating with the inner and outer cut scores and further providing a small tab lying on the upper surface of the cover above the cutout and being glued to the lift tongue area between the cut scores. The protective tab can be made from the same paperboard sheet as the cover by punching out the circular cover with a small satellite tab, preferably of circular shape tangentially connected thereto and having a perforated or cut scored connection line so that the satellite tab can be folded over the cutout area and subsequently glued.

In another modification, the protective tab can be made as a pressure sensitive adhesive label or tape having a patterned adhesive layer. The part of the label overlapping the pull or lift tongue is applied at an increased pressure so that positive adhesion results which enables the label to remain affixed to the lift tongue and assist in its lifting. The remaining part of the label is applied at a low pressure only so that it makes an easy to lift tab which is gripped by fingers and pulled thereby removing the lift tongue and the entire lid portion.

The novel features which are considered as characteristic for the invention are set forth in the appended claims. The invention itself, however, together with additional objects and advantages thereof, will be best understood from the following description of specific embodiments when read in connection with the accompanying drawing.

DESCRIPTION OF THE PREFERRED EMBODIMENTS

Figure 1:
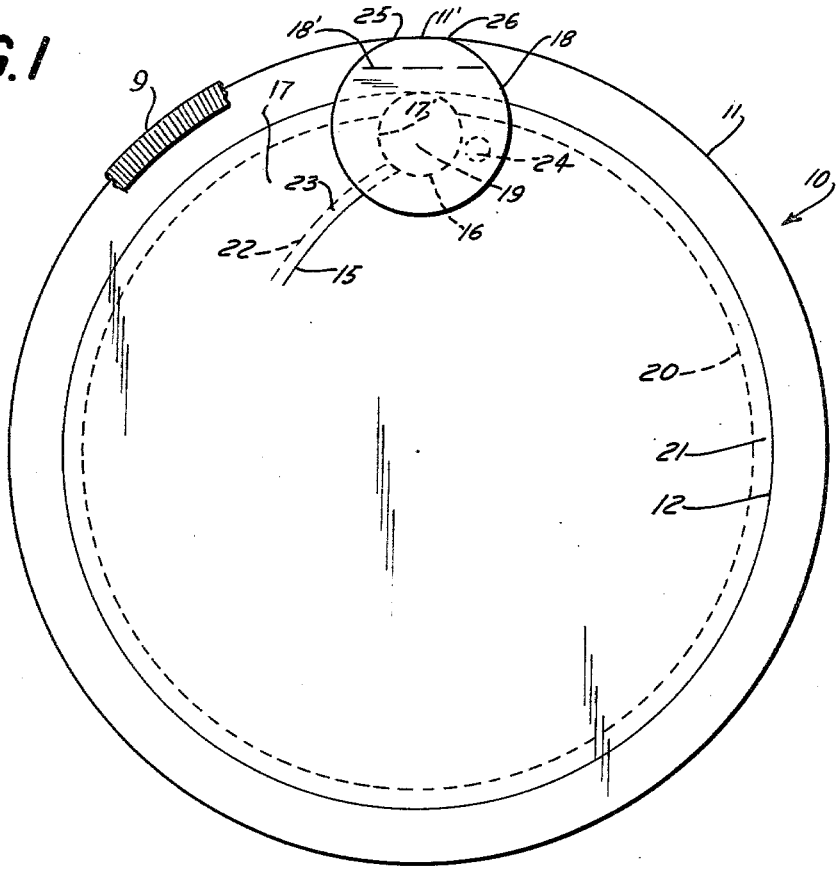
FIG. 1 is a top view of one embodiment of the cover of this invention having a circular cutout covered by a folded protective tab.

The container cover 10 shown in the drawing is designed to be crimped along its peripheral edge 11 by the sides of an aluminum pan and expansible aluminum top foil 9. The upper surface of cover 10 is provided with a continuous outer cut score line 12 which is spaced from the outer edge 11 of the cover. A second cut score line 15 is formed on the upper surface of the cover in a spaced relation to cut score line 12 and diverges therefrom inwardly so as to define a tongue like area 17. According to one feature of this invention, a circular cutout opening 19 for receiving a finger is provided at the beginning of the diverging cut score 15.

Figure 2:
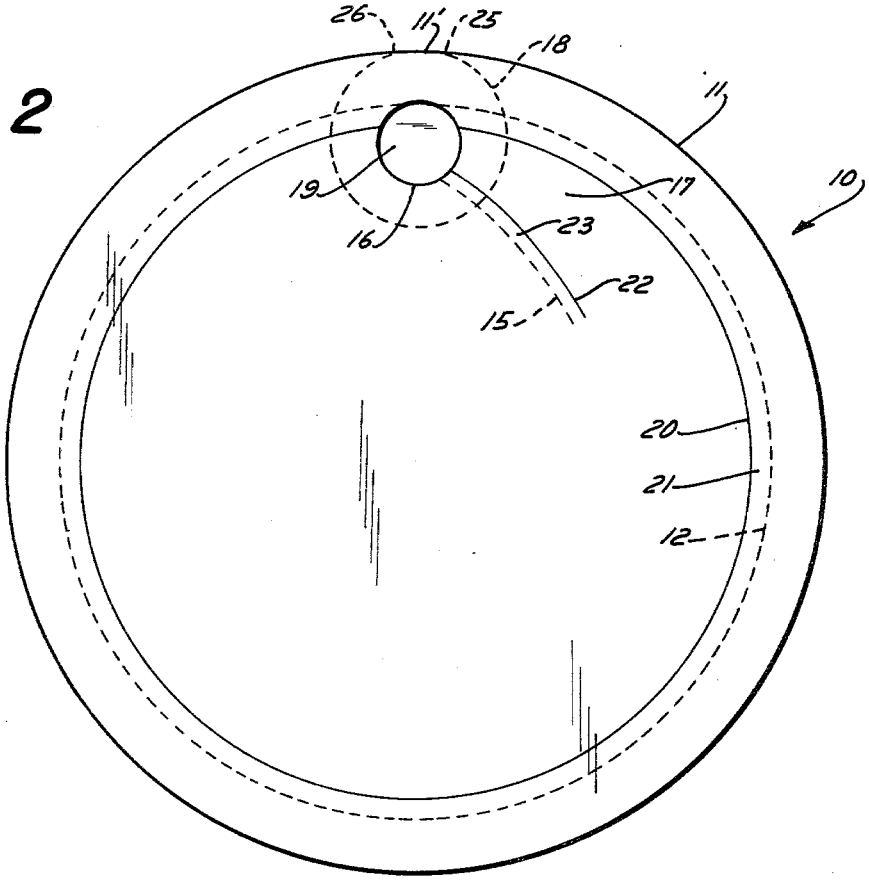
FIG. 2 is a bottom view of the cover of FIG. 1.

The bottom surface of the cover 10 (FIG. 2) is provided with a continuous cut score line 20 conforming in shape to and being uniformly spaced inwardly from cut score line 12. A second cut score line 22 on the lower surface in uniformly spaced outwardly from cut score line 15 on the upper surface. The resulting opening device is formed by having a tear strip 21 between the cut scores 12 and 20 and a tear strip 23 between cut scores 15 and 22. Between the tear strip 23 and the opposite section of the ring 21 results the aforementioned starting tongue 17 beginning in the circular cutout 19 and diverging inwardly therefrom. In starting the opening operation, the user can immediately grip the free edge 17' of the starting tongue 17 adjacent opening 19 and tear away along the score lines a major portion of the cover. In contrast to prior art opening devices of this kind using cross cuts which had to be first pressed down, in the device of this invention the depression causing the danger of puncturing the underlying expansible aluminum foil is eliminated.

To protect the aluminum foil portion exposed in the opening 19, the cover 10 is die cut in connection with a small satellite tab 18 connected to the edge 11 along a perforated connection line 11' extending between points 25 and 26 near the opening 19. The outside tab 18 is folded over onto the top surface of the cover and partially glued thereto at 24, thereby covering the opening 19 as well as a part of the starting tongue 17. The user can lift up the tab 18 and remove it by tearing along perforations 18' or leave it affixed and the opening process is initiated as described above.

Figure 3:
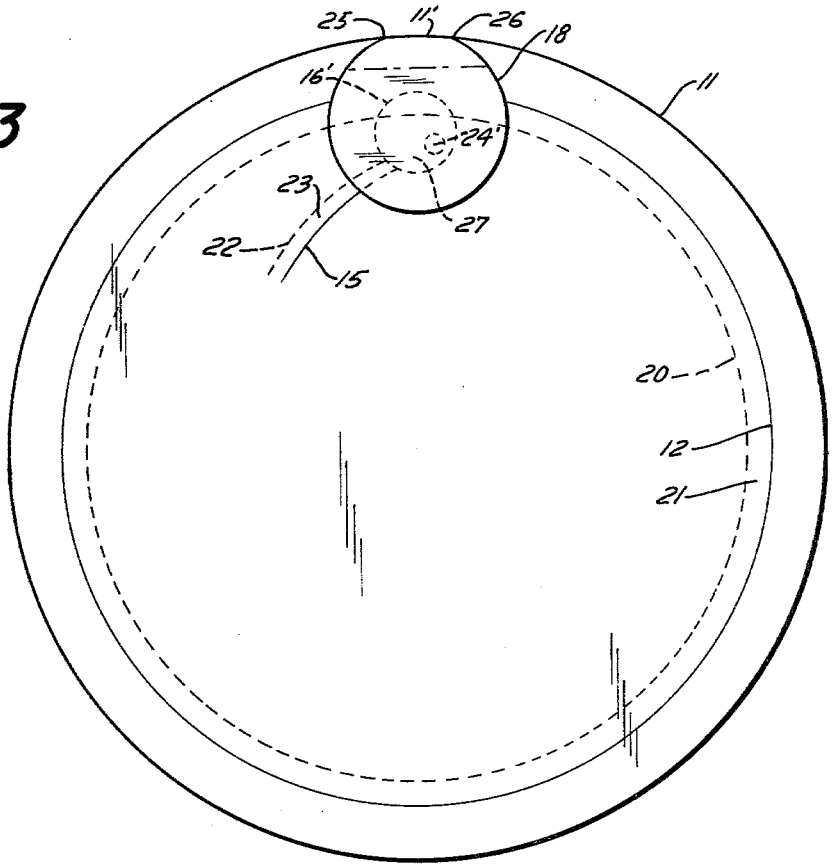
FIG. 3 is a top view of a modification of the cover of this invention.
Figure 4:
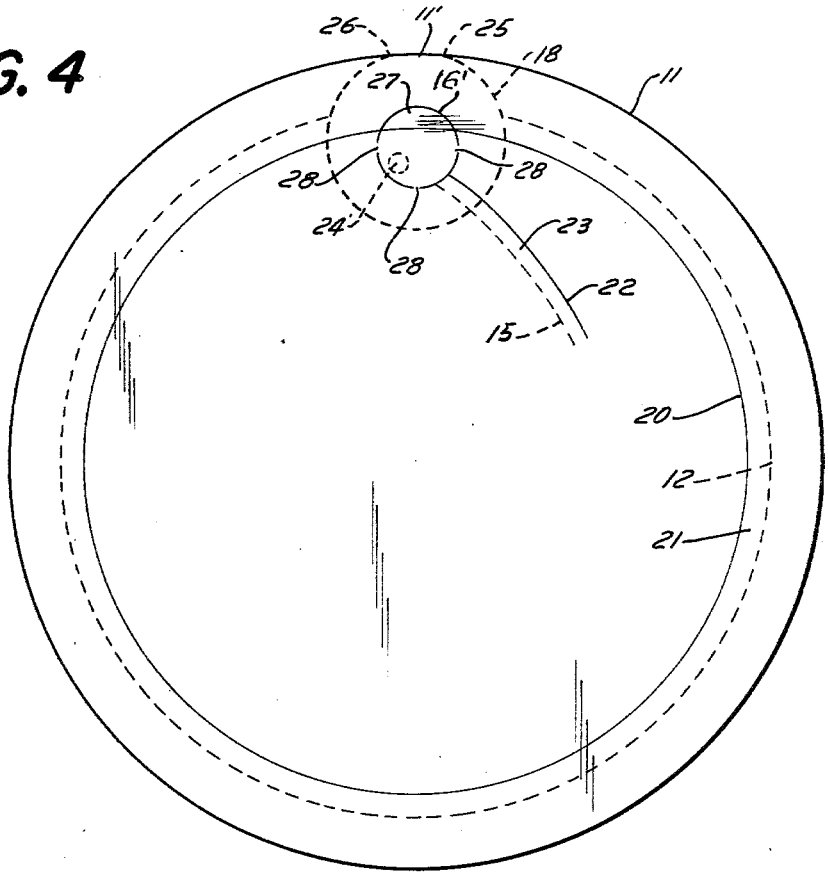
FIG. 4 is a bottom view of the cover of FIG. 3.

The embodiment of the invention shown in FIG. 3 is similar to that of FIG. 1 and like elements are shown by like numerals. However, instead of cuttting out an opening 19, small nicks 28 are left between the cuts 16' so that the scrap 27 is retained in the opening and held in position by these nicks. The scrap 27 adds extra protection for the spun aluminum foil underneath. The outside tab 18 is then folded over and glued directly on the area 24' on the scrap 27. In starting the opening process, the user when lifting the tab 18 tears away the tiny nicks 28 and removes the scrap from the opening.

Figure 5:
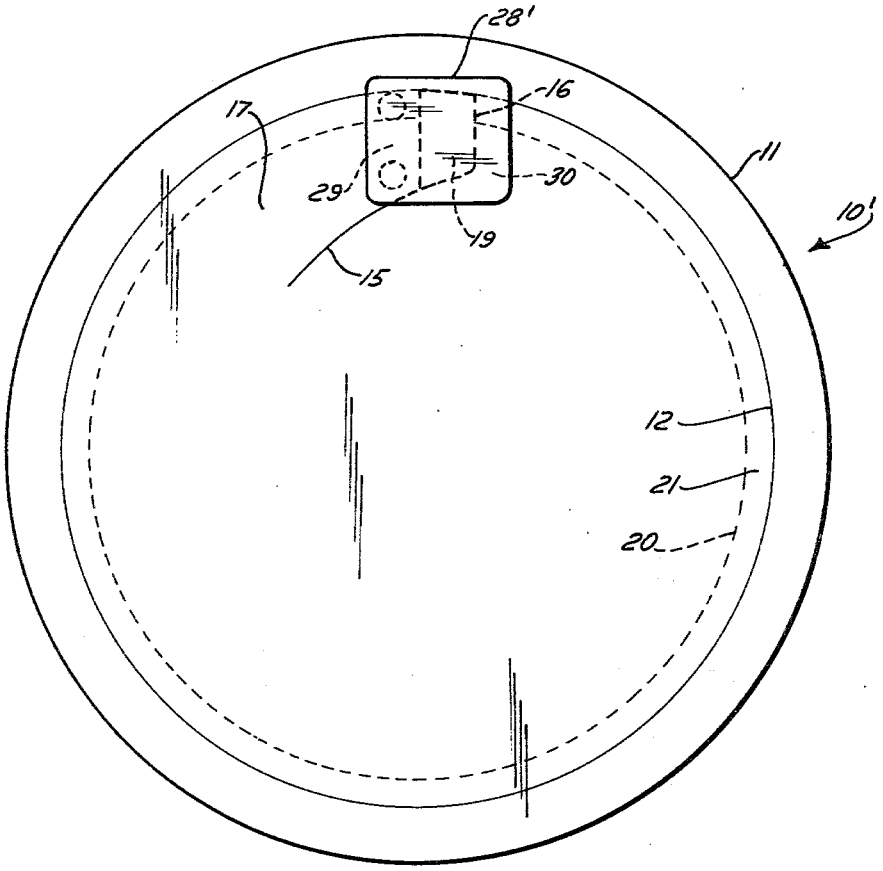
FIG. 5 is a top view of still another embodiment of this invention.
Figure 6:
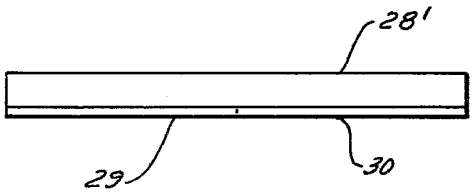
FIG. 6 is a side view of a protective tab as shown in FIG. 5.

Referring now to FIG. 5, the cover 10' is similar to that as shown in the example illustrated in FIG. 1 (similar elements being indicated by identical numerals) with the exception that the paperboard tab is replaced by a pressure sensitive adhesive label or tape 28' having its pressure sensitive layer patterned so as to define a positive adhesive portion 29 applied to the starting tongue 17 while the remaining portion of the tape has an easy lift adhesive so as to be used as an easy lift up tab 30. This tab 30 is lifted and pulled thereby removing the entire inner lid portion. It is possible of course to affix selectively the protective tape 28' by other adhesive means such as for example by wet adhesive, hot melt, flame sealing or by heat-and-pressure in addition to the pressure sealing.

It will be understood that each of the elements described above, or two or more together, may also find useful application in other types of protective covers differing from the types described above.

What is claimed as new and desired to be protected by Letters Patent is set forth in the appended claims.

1. An openable cover adapted to span and be marginally secured to a container comprising, in combination, a substantially flat paperboard sheet having a first cut score on the upper surface thereof, a second cut score on the lower surface thereof, said cut scores extending therearound and being substantially uniformly spaced from each other and from the edge of the sheet, a third cut score on the upper surface of the sheet spaced inwardly and diverging from said first cut score to define a starting tongue therewith, a fourth cut score spaced inwardly from the second cut score on the lower surface of said sheet, a cutout area communicating with said third and first cut scores, said cutout area having a substantially circular shape and crossing said first and third cut scores, a protective tab lying on the upper surface of said cover above said cutout area and being partially glued to said upper surface, and a paperboard scrap disposed in said cutout area in the plane of said cover and connected thereto by a plurality of small nicks, said protective tab being glued directly to said scrap.

2. A cover as defined in claim 1, wherein said protective tab has a circular shape and overlaps said cutout area.

3. A cover as defined in claim 2, wherein said protective tab is connected to an edge portion around a perforated connecting line and folded over around said connecting line upon the upper surface of said cover.

4. A cover as defined in claim 1, wherein said protective tab is a pressure sensitive adhesive label having a patterned adhesive layer defining a positive adhesive portion and easy to lift adhesive portion, said positive adhesive portion being applied to said starting tongue and the easy to lift adhesive portion defining a pull tab.

* * * * *